United States Patent [19]

Long et al.

[11] Patent Number: 4,744,308

[45] Date of Patent: May 17, 1988

[54] COMBINED CENTER PLATE/CENTER FILLER FOR RAILWAY FREIGHT CARS

[75] Inventors: Jack R. Long, St. Charles; Stephen W. Becker, Downers Grove, both of Ill.

[73] Assignee: National Castings, Inc., Cicero, Ill.

[21] Appl. No.: 18,207

[22] Filed: Feb. 24, 1987

[51] Int. Cl.[4] ..... B61F 5/16

[52] U.S. Cl. ..... 105/199.4; 105/228; 213/57

[58] Field of Search ..... 105/199.1, 199.4, 226, 105/228, 416, 420; 213/57; 901/42

[56] References Cited

U.S. PATENT DOCUMENTS 2,184,337 12/1939 Duryea ..... 105/228

4,540,869 9/1985 Yasuoka ..... 901/42 X

*Primary Examiner*—Sherman D. Basinger

*Attorney, Agent, or Firm*—Milton S. Gerstein; Marvin Benn

[57] ABSTRACT

A combined center plate/center filler construction for the underframe of a railway car is provided with sloped, corner circumferential sections at the upper portion of the center plate to allow for the complete welding of the center plate to the undersurfaces of a pocket-receptacle of the underframe, so that one continuous welding operation may be performed. The upper portion of the center plate has four corner positioning projections the upper horizontal surfaces of which are coplanar with the horizontal plane containing the joinder of the center plate to the center filler.

10 Claims, 2 Drawing Sheets

COMBINED CENTER PLATE/CENTER FILLER FOR RAILWAY FREIGHT CARS

BACKGROUND OF THE INVENTION

The present invention is directed to an improved body bolster center plate/center filler for a railway freight car. Conventional underframes of railway freight cars are supported on the truck therebelow by a pair of body bolster center plate/center filler constructions, the lower circular portion of each center plate being received within one of a pair of mating pivot-bowls mounted on the truck. Each center filler is integrally formed with the center plate, and is received within a square-shaped pocket formed at the intersection of the underframe's body bolster and center sill, as disclosed in U.S. Pat. No. 3,664,269. As disclosed in that patent, the combined center plate/center filler is secured to the body bolster and center sill by welding about the upper, square-shaped cross-sectional portion of the center plate, which upper portion is provided with sloped or canted surfaces about portions of the circumference thereof, which thereby welds the upper portion of the center plate to the undersurfaces of the side and tie plates forming the square-shaped pocket at the intersection of the body bolster and center sill. The center plate of the above-identified patent is also provided with four corner pads or vertically-projecting alignment surfaces which orient the square-shaped cross-sectional center filler within the square-shaped pocket, which alignment pads abut against the undersurfaces of the lowermost corners of the square-shaped pocket for positioning purposes. The canted or sloped surfaces on the upper, square-shaped portion of the center plate are located between the alignment pads, thereby allowing for a welded joint between the undersurfaces of the plates of the square-shaped pocket and the sloped surfaces of the upper portion of the center plate. However, the center plate/center filler disclosed in U.S. Pat. No. 3,664,269 suffers from the disadvantage of not allowing for the welding of the center plate to the undersurfaces of the square-shaped pocket by an automatic or robotic welder, since the welding about the plate is not carried out along the entire circumferential surface of the upper portion of the center plate, since neither the alignment pads themselves, nor the portion of the center plate associated with each alignment pad, offer a surface by which the center plate may be welded to the undersurfaces of the pocket plates defined thereat. This not only prevents a continuous operation of welding the center plate to the undersurfaces of the pocket, which prolongs and complicates the welding procedure, but also creates stress points along certain portions of the weldment adjacent to the alignment pads. Even in the case of welding the center plate to the square-shaped pocket undersurfaces by using a manual method rather than a robotic welding procedure, the welding gun must bypass each of the corner positioning pads by interrupting the welding process, and avoiding the obstacles created by the alignment pads themselves, since weldment thereat cannot be carried out.

SUMMARY OF THE INVENTION

It is, therefore, the primary objective of the present invention to provide a combined body bolster center plate/center filler construction that allows for continuous welding around the entire circumference of the upper, square-shaped portion of the center plate at the canted surfaces thereof, without the need of interrupting such welding procedure a plurality of times in order to bypass the corner alignment pads.

It is another objective of the present invention to allow for the welding of the center plate/center filler construction to the undersurfaces of the pocket by a continuous robotic welding apparatus.

It is yet another objective of the present invention to provide a welded joint between the sloped surfaces of the upper, square-shaped portion of the center plate and the undersurfaces of the center-filler receiving pocket, such that stress points are eliminated, and a more even distribution of forces is achieved, with a concomitant greater load-bearing capability being achieved and a longer lifespan thereof.

Toward these and other ends, the center plate/center filler construction of the invention is provided with sloped, corner circumferential sections, by which a continuous weldment may be provided between these corner circumferential sections and the undersurfaces of the pocket receiving therein the center filler. Each corner section has associated with it an upstanding positioning projection or pad for orienting the construction at the four lower corners of the pocket receiving the center filler. Each projection is situated along the outer perimeter of a corner recessed area of the square-shaped upper portion of the center plate, with the upper surface of each positioning projection lying coplanar with the juncture-line between the lowermost part of the center filler and the uppermost part of the upper portion of the center plate. Each positioning projection has an arcuate extent great enough so as to ensure that the undersurfaces of two mutually-perpendicular bottom side and tie plates of the pocket receiving the center filler rest upon the top horizontal surface of the respective positioning projection.

BRIEF DESCRIPTION OF THE DRAWINGS

The invention will be more readily understood with reference to the accompanying drawings, wherein.

DETAILED DESCRIPTION OF THE INVENTION

Figure 1:
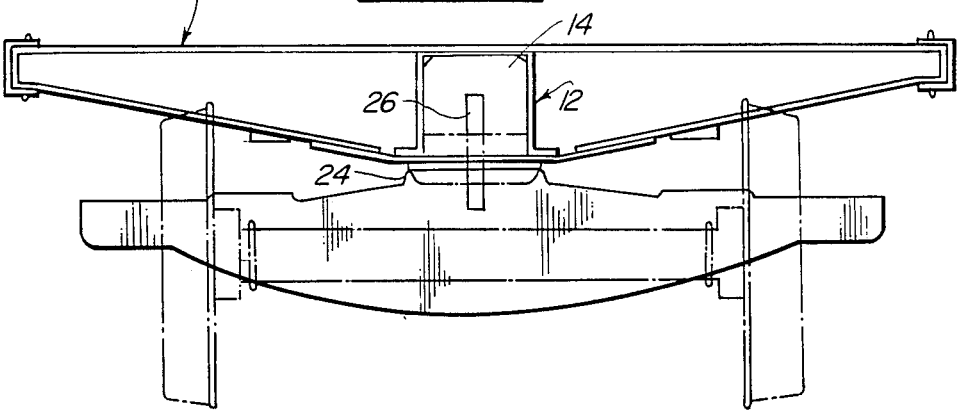
FIG. 1 is an end view showing the body bolster and center sill of the underframe of a railway car, in which is received the combined center plate/center filler of the present invention.
Figure 3:
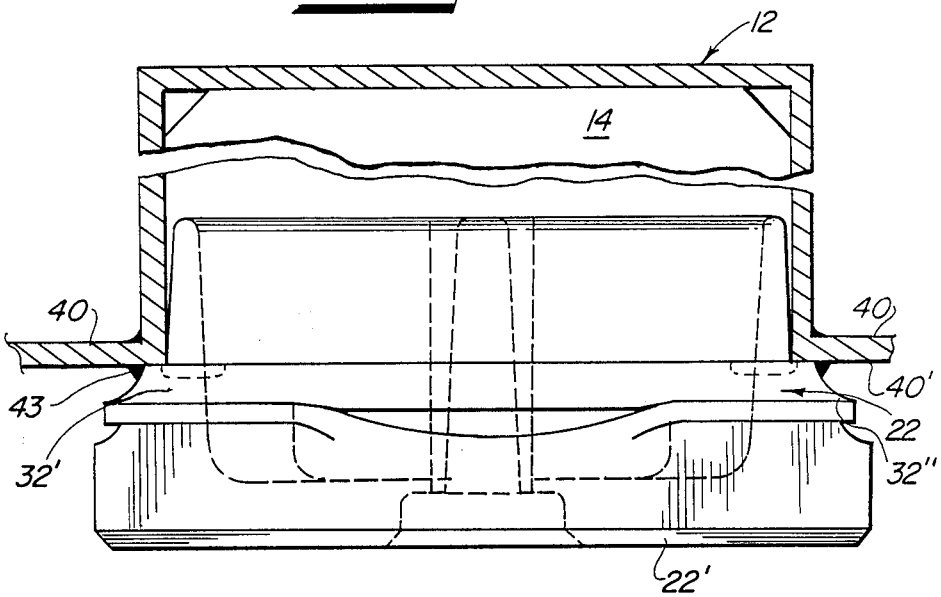
FIG. 3 is a detailed, partially broken-away side elevation view of the combined center plate/center filler of the present invention contained within the square-shaped receptacle of the underframe of a railway car.

Referring now to the drawings in greater detail, there is shown in FIG. 1 an underframe of a railway freight car which includes body bolster 10, which extends transversely of the car underframe, and a center sill 12 extending longidinally-axially of the underfame. At the intersection of the body bolster 10 and center sill 12, there is formed a box-type receptacle or pocket 14 and defined by downwardly-extending plates, as set forth in greater detail in U.S. Pat. No. 3,664,269. Received within the receptacle 14 is the center filler of the invention, indicated by reference numeral 20 in FIGS. 3 and 4. The center filler 20 is slightly tapered upwardly and inwardly, as clearly shown in FIG. 3, to provide a snug yet easily insertable fit. The center plate 22, shown in FIG. 3, is integrally formed with the center filler 20, and is made from cast steel as one unitary piece. The center plate 22 has a lower, bearing portion 22' which rests upon a pivot-bowl 24 provided on the truck positioned below the underframe of the railway car, and secured in place by king pin 26 in the conventional manner. The center filler 20 is formed by four sidewalls 27, and a centrally-located upstanding hub portion 28, through which is received the king pin 26. The hub portion 28 is connected to the side walls 26 via spiders 30 for reinforcing the hub portion 28.

Figure 5:
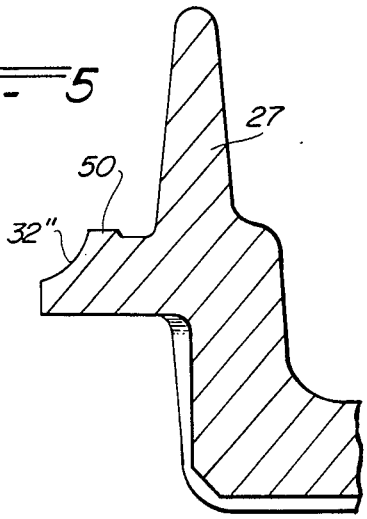
FIG. 5 is a detailed view of a corner alignment projection portion of the center plate/center filler construction of the present invention.
Figure 4:
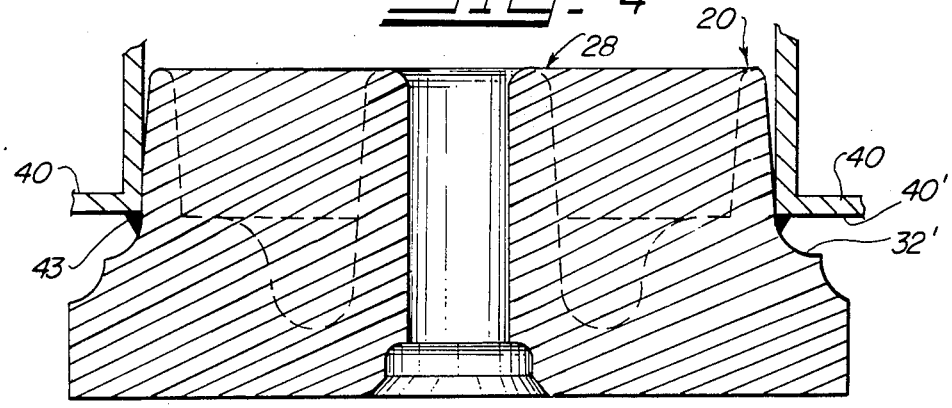
FIG. 4 is a cross-sectional view taken along line 4—4 of FIG. 2.

The center plate 22 includes an upper, substantially square-shaped cross-sectional portion 32, which is partially encircled by a canted or sloped surface 32', which thus provides for welding surfaces with the undersurface wall portions of the pocket 14. As shown in FIG. 4, the pocket 14 is provided with horizontally-disposed plates 40 on all four sides thereof, the undersurfaces 40' of which are used as weldment surfaces for connecting the canted surfaces 32' thereto, in the manner indicated by reference numeral 43 in FIG. 4, which shows a weldment thereof. The sloped surfaces 32' extend partially about the circumferential portion of the upper, square-shaped portion 32 of the center plate. Positioning projections or pads 50 are provided at each corner of the upper, square-shaped portion 32 of the center plate 22, which projections serve as positioning or aligning supports for orienting the center plate correctly, which projections 50 are to be located directly beneath the undersurfaces 40' of the plates 40 at the four corner areas of the pocket or receptacle 14. Each cooperating corner area of the upper portion 32 of the center plate is also provided with a sloped or canted surface 32'', which constitutes a continuation of the canted or sloped surfaces 32' of the remainder of the circumference of the upper portion 32, as shown in FIG. 5. Thus, there is provided a canted or sloped surface around the entire circumference of the upper section 32 of the center plate 22, by which the entire circumference of the upper portion of the center plate may be welded to the undersurfaces 40' of the horizontal plates 40, to provide a better securement of the center plate/center filler to the underframe of the railway car, as well as to allow for a single, continuous weldment operation of attachment of the center plate/center filler to the underframe, since there is no requirement of bypassing the four corner areas which include the positioning projections, as is necessary in the center plate/center filler disclosed in U.S. Pat. No. 3,644,269. Thus, not only is a stronger securement of the center plate/center filler achieved, but the entire operation may be continuous and, thereby, may allow for robotic weldment of the center plate/center filler to the underframe, which robotic weldment includes one continuous revolution of the welding gun about the sloped or canted surfaces 32' and 32'', without the need of a complete redirection of the path of movement of the welding gun to avoid the corner positioning projections.

Figure 2:
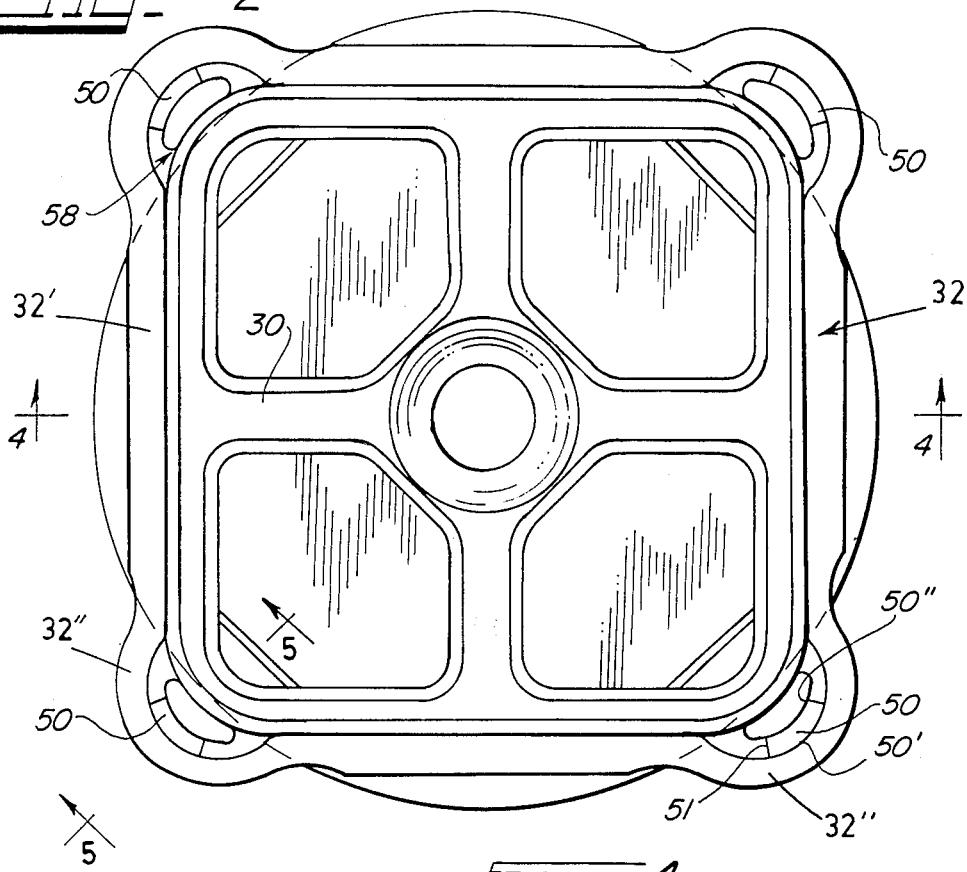
FIG. 2 is a top plan view of the combined center plate/center filler construction of the present invention.

Each upper, corner portion of the section 32 of the center plate, from which rises a corner alignment projection 50, is provided with an arcuate relief section 58 for relieving strain and concentration of forces. Each projection 50 is provided within one of these generally horizontal, enlarged relief areas 58, which each projection 50 occupying a part of the outer arcuate portion of the respective area. Each projection 50 is generally arcuate in shape, as clearly shown in FIG. 2, and projects one-eighth of an inch above the plane containing therein the upper surface of the relief area 58. The upper, horizontal surface of the projection 50 is also coplanar with the line of juncture between the upper portion of the sloped or canted surface 32' and a lowermost portion of the center filler 20.

In the preferred embodiment of the invention, each alignment projection or pad 50 has an arcuate extent, and has an outer perimeter surface 50' having a radius of curvature of 1½ inches, and inner perimeter surface 50'' of 1⅛ inches. The angle formed by the intersection of the two side edges 51 is sixty degrees. The arcuate length of each alignment or positioning projection is such as to ensure that each projection contacts the corner undersurfaces 40' of two mutually-perpendicular side and tie plates of the pocket 12. Each canted surface 32' and 32'' is preferably concavely shaped, with the radius of curvature of each canted surface being 1½ inches.

While a specific embodiment of the invention has been shown and described, it is to be understood that numerous changes and modifications thereof may be made without departing from the scope, spirit and intent of the invention, as set forth in the appended claims.

What is claimed is:

1. In a body bolster center plate/center filler construction for the underframe of a railway car, in which said center plate and said center filler are integrally constructed as a single, unitary piece, and wherein said center filler is a substantially rectilinear-shaped cross-sectional piece, and said center plate comprises a lower circular cross-sectional portion for resting upon a mating piece of a truck, and an upper portion of substantially rectilinear-shaped cross section of greater expanse than said rectilinear-shaped cross section of said center filler, said upper portion of said center plate comprising a plurality of corner positioning projections for abutment against lower corner edge surfaces of a rectilinear-shaped pocket formed by a railway car underframe center sill and body bolster, wherein the improvement comprises:

said upper portion of said center plate comprising four uppermost, corner recessed areas, each of said uppermost, corner recessed areas having one of said plurality of positioning projections projecting therefrom at the outer portion thereof adjacent the outer perimeter thereof, a respective said positioning projection extending above a horizontal plane containing therein an upper surface of the respective said corner recessed area;

said upper portion of said center plate further comprising from separate, sloped circumferential surface lenghts, each of said four circumferential surface lengths extending between two respective adjacent said corner recessed areas;

said upper portion of said center plate further comprising four sloped, corner circumferential sections, each respective said corner sloped circumferential section joining adjacent ends of two said sloped circumferential lengths, which said two circumferential lengths extend at substantially right angles to each other;

each of said sloped circumferential sections sloping upwardly and inwardly toward said center filler section and terminating at said outer perimeter of a respective said corner recessed area and bounded by the outer circumferential surface portion of a respective said positioning projection, whereby said center plate/center filler construction may be welded to the undersurfaces of a railway car's underframe pocket by welding completely about the entire circumferential surfaces of said upper portion of said center plate.

2. The improvement according to claim 1, wherein each of said corner recessed areas is substantially arcuate in length; each said positioning projection also being substantially arcuate in length, each of said positioning projection having an outer perimeter surface with a radius of curvature of $1\frac{1}{2}$ inches and an arcuate extent thereof of sixty degrees.

3. The improvement according to claim 2, wherein each said positioning projection projects upwardly from a respective said corner recessed area a height of one-eighth of an inch.

4. The improvement according to claim 1, wherein each said positioning projection comprises an outer perimeter surface substantially coextensive with at least a portion of the outer perimeter of a respective said corner recessed area with which it is associated;

each of said sloped, corner circumferential sections having an uppermost portion blending into said outer perimeter surface of the respective said positioning projection with which it is associated.

5. The improvement according to claim 4, wherein each of said sloped circumferential lengths and each of said sloped, corner circumferential sections are substantially concave in shape with the same radius of curvature.

6. The improvement according to claim 1, wherein each of said corner recessed areas defines a recessed surface area for relieving strain and excessive stress lying in a horizontal plane below a horizontal plane containing therein the uppermost portion of each of said four sloped circumferential surface lengths, said uppermost portions being joined to the respective lowermost portions of said center filler.

7. The improvement according to claim 6, wherein each of said positioning projections comprises an upper surface upon which may rest respective perpendicular undersurfaces of a pocket of an underframe of a railway car, each said upper surface being contained in said horizontal plane containing therein said uppermost portions of said sloped circumferential lengths.

8. The improvement according to claim 7, wherein each of said corner recessed areas is crescent-shaped so as to define an arcuate length thereof of each of the inner and outer boundries thereof, each of said positioning projections also being arcuate in length and projecting from a respective said corner recessed area at the outer arcuate perimeter portion thereof.

9. The improvement according to claim 8, wherein each outer arcuate boundary of each said positioning projection has a radius of curvature of $1\frac{1}{2}$ inches and extends for an arcuate length about the respective said corner recessed area for sixty degrees.

10. The improvement according to claim 9, wherein each of said four sloped circumferential lengths, and each of said sloped, corner circumferential sections have a radius of curvature of $1\frac{1}{4}$ inches.

* * * * *

UNITED STATES PATENT AND TRADEMARK OFFICE

CERTIFICATE OF CORRECTION

PATENT NO. : 4,744,308

DATED : May 17, 1988

INVENTOR(S) : Jack R. Long & Stephen W. Becker

It is certified that error appears in the above-identified patent and that said Letters Patent is hereby corrected as shown below:

On the Title page:

Under References cited, U.S. Patent Documents:

| | | | |
|---|---|---|---|
| 1,527,376 | 02/25 | O'Connor | |
| 1,754,634 | 04/30 | Martin | |
| 1,999,652 | 04/35 | Campbell | |
| 2,162,997 | 06/39 | Duryea | |
| 2,258,640 | 10/41 | Beckette | |
| 2,363,397 | 11/44 | Christiansen | |
| 2,655,117 | 10/53 | Travilla | 105/199 |
| 2,919,660 | 01/60 | Fillion | |
| 3,326,611 | 06/67 | Christian | |
| 3,664,269 | 05/72 | Fillion | 105/199C |
| 3,670,662 | 06/72 | Fillion | 105/199C |
| 3,703,239 | 11/72 | Furniss | 213/57 |
| 3,711,927 | 01/73 | Davidson | 29/401 |
| 3,719,154 | 03/73 | Reynolds | 105/199C |
| 3,770,139 | 11/73 | Glenn | 213/57 |
| 3,771,465 | 11/73 | Glenn | 105/199C |
| 3,797,674 | 03/74 | Reynolds | 213/57 |
| 3,831,530 | 08/74 | Cope et al. | 105/199C |
| 3,832,954 | 09/74 | Amwake | 105/199C |
| 3,834,774 | 09/74 | Fiegl | 308/137 |
| 3,859,928 | 01/75 | Adler | 105/199C |

UNITED STATES PATENT AND TRADEMARK OFFICE

CERTIFICATE OF CORRECTION

PATENT NO. : 4,744,308

DATED : May 17, 1988

INVENTOR(S) : Jack R. Long & Stephen W. Becker

It is certified that error appears in the above-identified patent and that said Letters Patent is hereby corrected as shown below:

| | | | |
|---|---|---|---|
| 3,973,681 | 08/76 | Martin et al. | 213/8 |
| 3,985,235 | 10/76 | Buzza | 213/57 |
| 4,056,065 | 11/77 | Fiegl et al. | 105/199C |
| 4,206,710 | 06/80 | Spence | 105/420 |
| 4,252,068 | 02/81 | Nolan | 105/420 |

Other Publications:

Association of American Railroads - Manual of Standards, 1969, "Bolster Center Filler."

IN THE SPECIFICATION:

Column 4, line 22, "1-1/2" should be -- 1-1/4 --;

Column 4, line 55, "from" should be -- four --;

Column 4, line 56, "lenghts" should be --lengths --.

Signed and Sealed this

Thirteenth Day of December, 1988

*Attest:*

*Attesting Officer*

DONALD J. QUIGG

*Commissioner of Patents and Trademarks*